US006344637B2

(12) United States Patent
Lee et al.

(10) Patent No.: US 6,344,637 B2
(45) Date of Patent: Feb. 5, 2002

(54) COOLING SYSTEM FOR BUILT-IN MICROWAVE OVEN

(75) Inventors: Sung-Geon Lee; Joo-Yong Kim; Hyo-Yun Jung; Dae-Sik Kim; Yun-Seok Lee; Gil-Sup Jeong; Gyu-Ho Oh, all of Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/736,128

(22) Filed: Dec. 15, 2000

(30) Foreign Application Priority Data

| | | |
|---|---|---|
| Dec. 18, 1999 | (KR) | 99/58847 |
| Dec. 18, 1999 | (KR) | 99/58855 |
| Dec. 18, 1999 | (KR) | 99-58857 |
| Jun. 5, 2000 | (KR) | 2000-30768 |
| Jun. 5, 2000 | (KR) | 2000/30770 |

(51) Int. Cl.[7] ..... H05B 6/80

(52) U.S. Cl. ..... 219/757; 219/681; 126/21 A; 126/273 A; 126/299 D

(58) Field of Search ..... 219/757, 681, 219/685, 400; 126/21 A, 273 A, 275 E, 299 R, 299 D

(56) References Cited

U.S. PATENT DOCUMENTS

| | | | | |
|---|---|---|---|---|
| 4,180,049 A | * | 12/1979 | Carr et al. | 219/757 |
| 4,184,945 A | * | 1/1980 | Morgan et al. | 219/757 |
| 4,327,274 A | * | 4/1982 | White et al. | 219/757 |
| 4,354,084 A | * | 10/1982 | Husslein et al. | 219/757 |
| 6,005,235 A | * | 12/1999 | Shin | 219/757 |

FOREIGN PATENT DOCUMENTS

| | | | | |
|---|---|---|---|---|
| JP | 1-200121 | * | 8/1989 | 219/757 |

* cited by examiner

*Primary Examiner*—Philip H. Leung
(74) *Attorney, Agent, or Firm*—Fleshner & Kim, LLP

(57) ABSTRACT

A built-in microwave oven is provided, installed in the kitchen furniture as an integral part of the furniture. In the microwave oven, a suction grille and an exhaust grille are provided on the front wall of the external casing, and so cooling air is sucked and discharged through the front wall of the casing. Upper and lower heaters are installed within the casing, with an upper inside air passage formed around the upper heater that guide an air current formed by an upper heater cooling fan, and another air passage is formed around the lower heater that guides an air current formed by a lower heater cooling fan. The inflow air from the suction grille is partially and directly guided to the exhaust grille so as to be mixed with hot air from the upper and lower heaters prior to being discharged from the external casing to the atmosphere through the exhaust grille. Therefore, the exhaust air from the exhaust grille is preferably reduced in its temperature to a proper low point.

31 Claims, 4 Drawing Sheets

COOLING SYSTEM FOR BUILT-IN MICROWAVE OVEN

TECHNICAL FIELD

The present invention relates to microwave ovens and, more particularly, to a built-in microwave oven, designed to be installed in kitchen furniture at a predetermined position as an integral part of the kitchen furniture.

BACKGROUND ART

As well known to those skilled in the art, a microwave oven is an electrically operated oven using high-frequency electromagnetic waves that penetrate food, causing its molecules to vibrate and generating heat within the food to cook it in a short time. Conventional microwave ovens are classified into two types: a tabletop microwave oven designed to be seated on a table and a ventilation hood-combined microwave oven integrated with a gas range at the top portion of the gas range and collaterally acting as a ventilation hood.

In recent years, some kinds of electric kitchen appliances, such as gas oven ranges and pickled vegetable refrigerators, have been designed as built-in types in an effort to accomplish the recent trend of compactness of kitchen systems. Such built-in kitchen appliances preferably accomplish a desired harmony and a desired integration of the electric kitchen appliances with kitchen furniture.

In addition, conventional microwave ovens are typically designed to radiate high-frequency electromagnetic waves from a magnetron into the cooking cavity to allow the electromagnetic waves to penetrate food within the cavity, thus causing molecules of the food to vibrate and generating heat within the food to cook it in a short time. However, such a conventional microwave oven is problematic in that it undesirably has only a single heating mode with high-frequency electromagnetic waves, and so another type of microwave oven having a heater in addition to such a magnetron has been recently proposed and used. That is, microwave ovens, designed to use heat of a heater in addition to high-frequency electromagnetic waves of a magnetron so as to accomplish the requirement for a variety of heating modes and a variety of heating conditions, have been proposed.

The representative example of conventional heaters used in such microwave ovens having heaters in addition to magnetrons is a quartz tube heater. In the microwave oven having such a quartz tube heater as an additional heat source, heat from the quartz tube heater is forcibly convected within the cooking cavity to accomplish a convection-heating effect and to heat food within the cavity to a higher temperature.

Still another type of microwave oven provided with a halogen lamp capable of generating higher temperature heat and browning the surface of food has been proposed and used. In such a microwave oven, halogen lamps are installed at the top and bottom wall of the cavity of the oven, and radiate heat energy and light energy into the cavity, thus heating food within the cavity more quickly. When such halogen lamps are installed in microwave ovens, the lamps generate very high temperature heat, and so it is necessary to additionally install a cooling device for effectively cooling the halogen lamps and the surroundings of the lamps.

In accordance with the recent trend of built-in type structure of kitchen appliances, consumers require built-in microwave ovens. In such built-in microwave ovens, it is desired to install additional heaters, such as halogen lamps, in the ovens so as to accomplish a variety of heating modes and a variety of heating conditions of said ovens.

Such built-in microwave ovens are also set in kitchen furniture as integral parts of the furniture, with only the front walls of the ovens exposed from the front surface of the furniture to allow users to reach said front walls. Therefore, it is necessary to design such built-in microwave ovens to allow air to pass through only the front walls of the ovens.

During an operation of such a built-in microwave oven, the heater, in addition to the magnetron and the high voltage transformer installed within the machine chamber, generates high temperature heat.

It is thus necessary to cool the heater and the other heat generating elements of a built-in microwave oven using cooling air current. In such a built-in microwave oven, the air passage for the cooling air has to be provided at the front wall of the oven. However, such an air passage structure for built-in microwave ovens is completely different from that of the other types of conventional microwave ovens, and so it is impossible to use the conventional air passage structures in the built-in microwave ovens.

In addition, after the process of cooling the heater, magnetron and high voltage transformer during an operation of a built-in microwave oven, hot air is discharged from the external casing of the oven through the front wall of the oven to directly reach a user, thus making the user feel unpleasant. The hot air discharged from the front wall of the built-in microwave oven also damages or incapacitates elements set in the front wall.

DISCLOSURE OF THE INVENTION

Accordingly, the present invention has been made keeping in mind the above problems occurring in the prior art, and an object of the present invention is to provide a built-in microwave oven, which is designed to be installed in kitchen furniture at a predetermined position as an integral part of the kitchen furniture, and which allows cooling air for heat dissipation to pass through the front wall of the oven.

Another object of the present invention is to provide a built-in microwave oven, which is designed to desirably reduce the temperature of cooling air to a reasonable low point when the air is discharged from the external casing of the oven through the front wall of the oven after cooling the heat generating elements.

In order to accomplish the above object, the present invention provides a built-in microwave oven, comprising: a suction grille provided on the front wall of an external casing at a predetermined position for sucking air into the external casing; an exhaust grille provided on the front wall of the external casing at another predetermined position for discharging air from the external casing to the atmosphere; and means for forming air currents within the external casing while guiding inflow air from the suction grille to allow the inflow air to pass within the external casing prior to discharging the air from the external casing to the atmosphere through the exhaust grille.

In the above microwave oven of this invention, the suction grille and the exhaust grille are formed on the front wall of the external casing at predetermined positions. It is thus possible to provide effective built-in microwave ovens.

In accordance with another embodiment, the present invention provides a built-in microwave oven, comprising: a suction grille provided on the front wall of the external casing of the microwave oven at a predetermined position for sucking air into the external casing; an exhaust grille provided on the front wall of the external casing at another predetermined position for discharging air from the external casing to the atmosphere; at least one heating means used for heating food seated within a cooking cavity of the oven; a first air passage guiding a part of inflow air from the suction grille to the exhaust grille; a second air passage guiding a remaining part of the inflow air from the suction grille to the exhaust grille while allowing the air to pass by the heating means to cool the heating means; and means for forming air currents within the external casing by sucking the inflow air through the suction grille and by allowing the inflow air to pass through both the first and second air passages prior to discharging the air from the external casing to the atmosphere through the exhaust grille, whereby the first and second air passages are joined together at a position before the exhaust grille.

In the built-in microwave oven of this invention, it is possible to effectively reduce the temperature of exhaust air discharged from the external casing of the oven through the exhaust grille to a reasonable low temperature. Therefore, the exhaust air of the built-in microwave oven of this invention is almost completely free from thermally damaging or incapacitating the elements set on the front wall of the oven or undesirably making users standing or sitting in front of the oven feel unpleasant.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
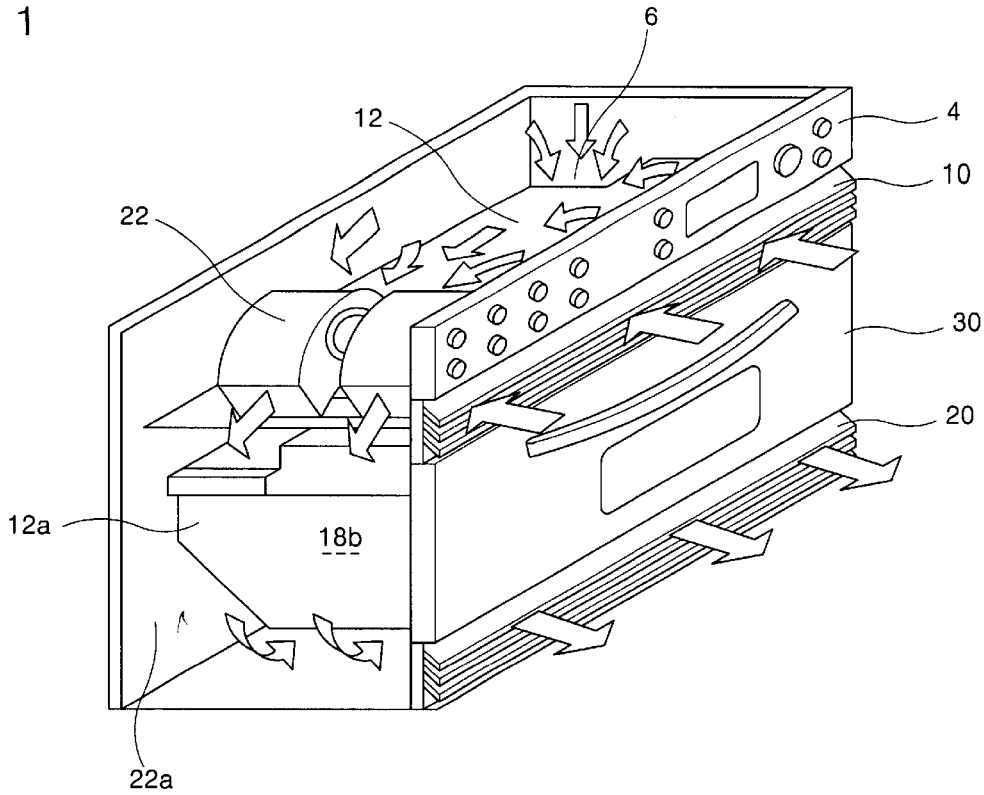
FIG. 1 is a top perspective view of a built-in microwave oven in accordance with the primary embodiment of the present invention.

Reference now should be made to the drawings, in which the same reference numerals are used throughout the different drawings to designate the same or similar components.

FIG. 1 is a top perspective view of a built-in microwave oven in accordance with the primary embodiment of the present invention. As shown in the drawing, the built-in microwave oven according to the primary embodiment of this invention has a cooking cavity, which seats food therein and heats the food. The front wall of the external casing of the microwave oven is provided with a suction grille 10 and an exhaust grille 20. The suction grille 10 is provided at the upper portion of the front wall for sucking atmospheric air into the external casing of the oven to cool the heat generating elements of the oven during an operation of the oven. The exhaust grille 20 is provided at the lower portion of the front wall for discharging air from the external casing of the oven to the atmosphere after the air circulates in the oven while cooling the heat generating elements.

Since the suction grille 10 and the exhaust grille 20 are positioned at the front wall of the oven at positions above and under the front door 30, the inflow air sucked through the suction grille 10 is introduced into the upper portion of the cavity, while the outflow air discharged through the exhaust grille 20 flows through the lower portion of the cooking cavity prior to being discharged from the cavity.

The internal construction of the oven and the air circulation in the oven will be described herein below with reference to FIGS. 1 to 4. As shown in the drawing, the suction force used for sucking atmospheric air into the external casing of the oven through the suction grille 10 is partially generated by an exhaust motor 22 provided on an upper partition panel 12.

Figure 5:
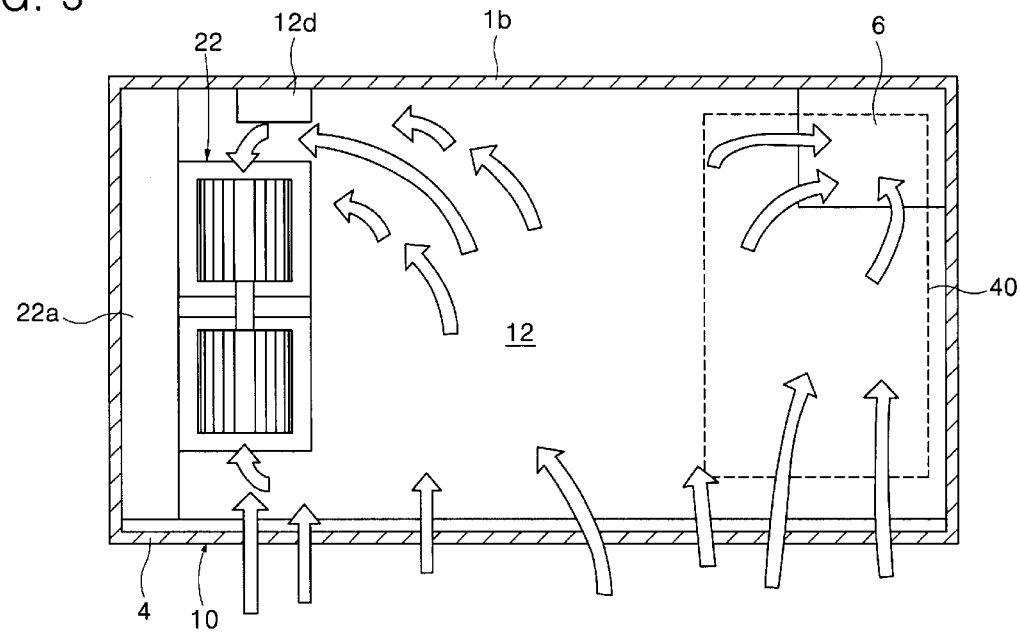
FIG. 5 is a plan view of the built-in microwave oven of FIG. 1, particularly showing the construction of the top portion of the microwave oven.

As best seen in FIG. 5, the exhaust motor 22 is installed on the upper partition panel 12 at a left-hand side position of the drawing, that is, at a position opposite to a machine chamber 40. The exhaust motor 22 generates suction force for sucking atmospheric air into the external casing of the oven through the suction grille 10. The above exhaust motor 22 is spaced apart from a control panel 4 by a predetermined gap, and is spaced apart from the rear wall 1*b* of the external casing of the oven by a predetermined gap. The control panel 4 is provided on the front wall of the oven at a position above the suction grille 10. Therefore, the inflow air from the suction grille 10 primarily passes by the exhaust motor 22 while passing over the opposite sidewalls of the motor 22 as shown by the arrows in FIG. 5.

Thereafter, the inflow air secondarily flows down from the exhaust motor 22 through a first side air passage 22*a* defined inside the sidewall 1*c* of the external casing, and finally flows through the gap between the bottom wall 2*a* of the cooking cavity 2 and the bottom wall id of the external casing prior to being discharged from the external casing of the oven to the atmosphere through the exhaust grille 20. In the operation of the oven, the inflow air sucked into the external casing of the oven through the suction grille 10 by the suction force of the exhaust motor 22 is atmospheric air having a room temperature or a low temperature.

In such a case, the above-mentioned air current is mixed with hot air, flowing from upper and lower heaters 32*a* and 32*b* after cooling the heaters 32*a* and 32*b*, prior to being discharged from the external casing of the oven through the exhaust grille 20. Therefore, the outflow air discharged from the external casing to the atmosphere through the exhaust grille 20 has a reasonable temperature since it is formed as a result of mixing the relatively low temperature air flowing from the exhaust motor 22 and the hot air flowing from the heaters 32*a* and 32*b*.

Figure 4:
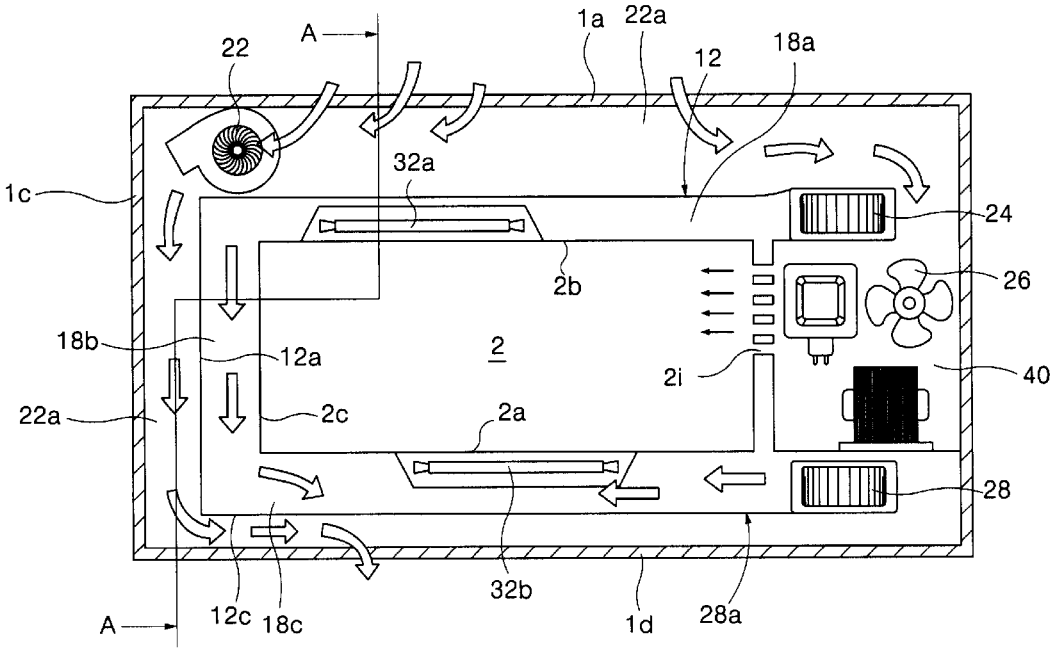
FIG. 4 is a sectional view of the built-in microwave oven of FIG. 1, particularly showing the internal construction of the microwave oven.

As shown in FIG. 4, the upper heater 32*a* is externally installed on the top wall 2*b* of the cooking cavity 2, while the lower heater 32*b* is externally installed on the bottom wall 2*a* of the cavity 2. In the microwave oven of this invention, the two heaters 32*a* and 32*b* act as an additional heating means for generating heat used for heating food in the cavity 2.

The upper heater 32*a* is externally installed on the top wall 2*b* of the cavity 2, while the upper partition panel 12 is positioned above said top wall 2*b* such that a predetermined gap is defined between the panel 12 and the top wall 2*b* to form an upper inside air passage 18*a* for allowing cooling air for the upper heater 32*a* to pass through. The upper portion above the cavity 2 within the external casing of the oven is divided into two air passages, that is, the upper inside air passage 18*a* and an upper outside air passage 22*a*, which allow the cooling air to separately pass through.

An upper heater cooling fan 24 is installed on the top wall of the machine chamber 40, and is used for cooling the upper heater 32*a*. The pressurized air current formed by the above cooling fan 24 is sucked into the machine chamber 40 to flow in the upper inside air passage 18*a* formed between the upper partition panel 12 and the top wall 2*b* of the cavity 2. Therefore, the upper heater 32*a* installed within the upper inside air passage 18*a* is properly cooled by the cooling air current flowing in the air passage 18*a*.

The upper inside air passage 18*a* communicates with a second side air passage 18*b* formed outside the left-hand sidewall of the cooking cavity 2 as shown in the drawings. A side partition panel 12*a* extends downward from the left-hand end of the upper partition panel 12 while being spaced apart from the left-hand sidewall 2*c* of the cavity 2 by a predetermined parallel gap, with the second side air passage 18*b* formed between the left-hand sidewall 2*c* of the cavity 2 and the side partition panel 12*a*.

The pressurized air current formed by the upper heater cooling fan 24 primarily passes through the upper inside air passage 18*a* while cooling the upper heater 32*a*, and passes down along the second side air passage 18*b*. In such a case, the outflow air from the second side air passage 18*b* has a high temperature since it absorbs heat from the upper heater 32*a* while passing through the upper inside air passage 18*a*. On the other hand, the air current, flowing in the first side air passage 22*a* formed between the side partition panel 12*a* and the sidewall 1*c* of the external casing, has a low temperature since most part of said air current is formed by atmospheric air newly sucked into the external casing of the oven through the suction grille 10 as described above.

Figure 2:
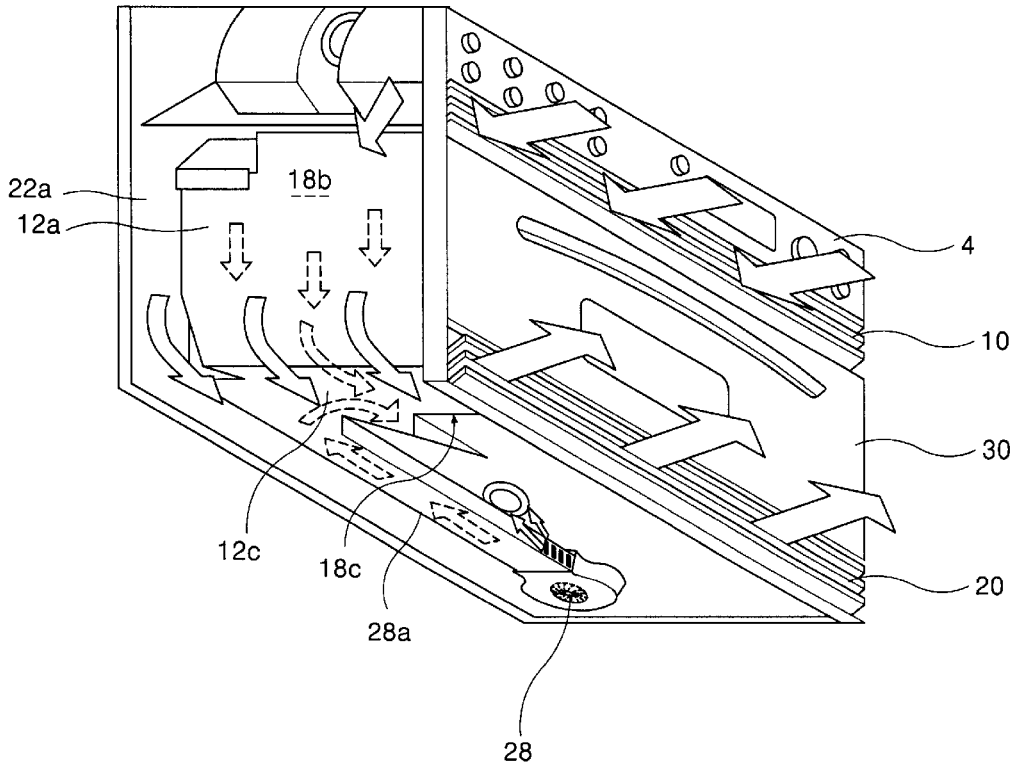
FIG. 2 is a bottom perspective view of the built-in microwave oven of FIG. 1.

A lower partition panel 12*c* extends horizontally from the lower end of the side partition panel 12*a* in a rightward direction at a position under the bottom wall 2*a* of the cavity 2 as shown in FIGS. 2 and 4. A lower air passage 18*c* is defined between the lower partition panel 12*c* and the bottom wall 2*a* of the cavity 2 at a left-hand end position in the drawings. The hot air from the second side air passage 18*b* is thus introduced into the lower air passage 18*c* prior to being discharged from the passage 18*c* through the right-hand open end of said passage 18*c*. In addition, the lower air passage 18*c* formed by the lower partition panel 12*c* partially communicates with a lower heater cooling air passage 28*a* as will be described in detail later herein.

Figure 3:
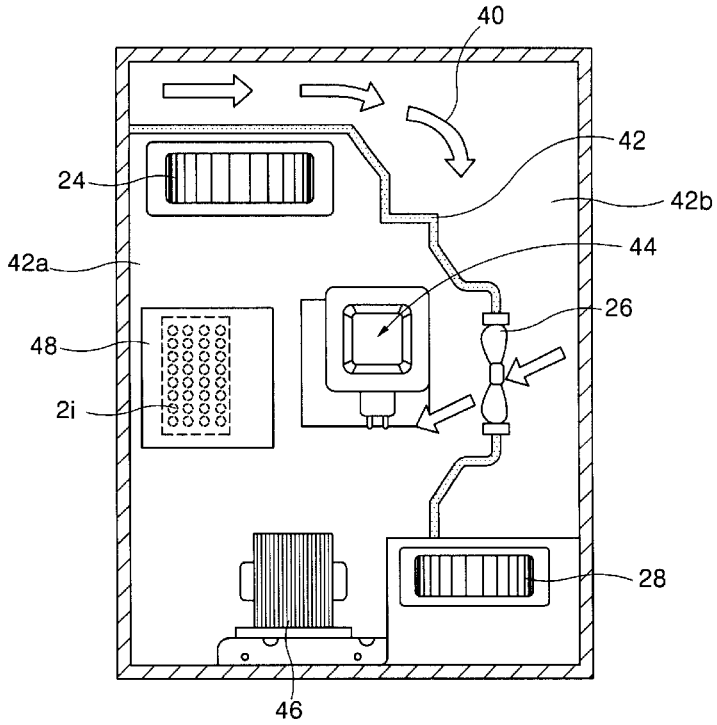
FIG. 3 is a side view, showing the construction of a machine chamber included in the built-in microwave oven of FIG. 1.

As best seen in FIGS. 3 and 4, a lower heater cooling fan 28 is installed at a predetermined position under the machine chamber 40 encasing both a magnetron 44 and a high voltage transformer 46, and is used for cooling a lower heater 32*b*. The above lower heater cooling fan 28 sucks an air current from the machine chamber 40 and cools the lower heater 32*b* installed on the bottom wall 2*a* of the cavity 2.

The pressurized air current formed by the lower heater cooling fan 28 passes through the lower heater cooling air passage 28*a* formed under the bottom wall 2*a* of the cavity 2. The above lower heater 32*b* is installed on the bottom wall 2*a* of the cavity 2 at a predetermined position within the lower heater cooling air passage 28*a*, and so the air current flowing in said air passage 28*a* properly cools the lower heater 32*b*. In such a case, the outflow air from the lower heater cooling air passage 28*a* has a high temperature since it absorbs heat from the lower heater 3*b* while passing through the air passage 28*a*.

As shown in FIG. 2, the lower heater cooling air passage 28*a* is designed to partially communicate with the lower air passage 18*c*. Therefore, the hot air from the lower heater cooling air passage 28*a* is mixed with the hot air from the second side air passage 18*b* at the lower air passage 18*c*.

The outflow air from the outlet end of the lower air passage 18*c* is hot air having a high temperature since the air absorbs heat from the upper and lower heaters 32*a* and 32*b*. The hot outflow air from the lower air passage 18*c* is, thereafter, mixed with low temperature air from the first side air passage 22*a*, thus becoming mixed air properly reduced in its temperature by the low temperature air from the first side air passage 22*a*. The resulting mixed air having a reasonable low temperature is, thereafter, discharged from the external casing of the oven to the atmosphere through the exhaust grille 20 of the front wall of the external casing.

FIGS. 3 and 4 also show another air current within the external casing of the oven of this invention. As shown in the drawings, a magnetron 44 used for generating high-frequency electromagnetic waves and a high voltage transformer 46 used for supplying a high voltage to the magnetron 44 are installed within the machine chamber 40 at predetermined positions. When the oven of this invention is turned on, both the magnetron 44 and the high voltage transformer 46 generate heat, and so it is necessary to cool the magnetron 44 and the high voltage transformer 46. In order to accomplish the above object, a machine chamber cooling fan 26 is installed within the machine chamber 40 at a proper position.

In the preferred embodiment of the invention, the above machine chamber cooling fan 26 is vertically mounted to an internal frame 42 of the machine chamber 40 such that the fan 26 effectively forms a forward cooling air current within the machine chamber 40 to cool the magnetron 44 and the transformer 46. In the present invention, it should be understood that the above fan 26 may be somewhat inclinedly positioned within the machine chamber 40 at a predetermined angle of inclination to effectively form a cooling air current form both the magnetron 44 and the transformer 46. In the preferred embodiment shown in the drawings, the fan 26 is installed on an internal partition wall 42 within the machine chamber 40. However, it should be understood that the mounting structure for the fan 26 may be changed from the above-mentioned structure without affecting the functioning of this invention.

The internal partition wall 42 is installed within the machine chamber 40 as shown in FIG. 3, and divides the interior of the chamber 40 into front and rear chambers 42*a* and 42*b* when observing the interior of the chamber 40 from a side. In the microwave oven of this invention, the heat generating elements, such as the magnetron 44 and the high voltage transformer 46, are installed within the front chamber 42*a* of the machine chamber 40. Therefore, the rear chamber 42*b* of the machine chamber 40 is filled with a low temperature air. The above rear chamber 42*b* communicates with an air inlet opening 6 of the machine chamber 40 as best seen in FIGS. 1 and 5.

When the machine chamber cooling fan 26 is turned on, a part of inflow air sucked into the external casing of the oven through the suction grille 10 is primarily introduced into the rear chamber 42*b* of the chamber 40 through the air inlet opening 6, and secondarily flows into the front chamber 42*a* of the chamber 40.

That is, the machine chamber cooling fan 26 generates a suction force for guiding a part of the inflow air from the suction grille 10 into the machine chamber 40 through the air inlet opening 6. This also means that the microwave oven of this invention is designed to allow the machine chamber cooling fan 26 to generate a part of the suction force used for sucking air from the atmosphere into the external casing of the oven through the suction grille 10.

Of course, it should be understood that the construction of the machine chamber cooling fan 26 may be somewhat freely changed from the above-mentioned construction if the changed construction effectively generates pressurized cooling air current capable of properly cooling the heat generating elements, such as the magnetron 44 and the high voltage transformer 46, set within the machine chamber 40.

As shown in FIGS. 3 and 4, the pressurized air current formed by the machine chamber cooling chamber 26 primarily passes by the magnetron 44 and the transformer 46 to cool them, and is secondarily guided into the cooking cavity 2 through an air duct 48. The shape of this air duct 48 is properly designed to smoothly guide the air current from the machine chamber 40 into the cooking cavity 2, and is provided on the sidewall of the machine chamber 40 at a position around the cooking cavity 2. The air from the duct 48 is introduced into the cooking cavity 2 through an air inlet opening 2i formed on the sidewall of the cavity 2.

In the present invention, a damper device provided with a baffle for selectively intercepting the inflow air for the cavity 2 may be installed within the air duct 48. The object of such a damper device is to prevent an undesired reduction in the interior temperature of the cooking cavity 2 due to an introduction of external air into the cavity 2, when it is desired to maintain the interior of the cavity 2 at a high temperature to effectively heat and cook the food within the cavity 2. The construction and operation of such a damper device is well known to those skilled in the art, and further explanation is thus not deemed necessary.

As described above, the pressurized air current, formed by the machine chamber cooling fan 26, passes through the cooking cavity 2 prior to being finally discharged from the external casing of the oven. FIG. 5 shows an air passage structure for allowing the air to be discharged from the cavity 2 and to be finally discharged from the external casing of the oven in accordance with an embodiment of the present invention. As shown in the drawing, a connection passage 12*d* is formed on the upper partition panel 12 such that the passage 12*d* communicates with the interior of the cooking cavity 2. Therefore, the air is primarily discharged from the cavity 2 through the connection passage, and secondarily passes through the first side air passage 22*a* prior to being finally discharged from the external casing to the atmosphere. In accordance with another embodiment of the present invention, the air passage structure for allowing the air to be discharged from the cavity 2 and to be finally discharged from the external casing may comprise an exhaust unit having a plurality of ventilation holes formed on the top wall 2*b* of the cavity 2 in the same manner as that of conventional microwave ovens. In the case of a microwave oven having such an exhaust unit with the ventilation holes, the air may be primarily discharged from the cavity 2 through the ventilation holes, and secondarily passes through the second side air passage 18*b* prior to being finally discharged from the external casing through the exhaust grille 20.

As described above, three fans are installed within the external casing of the oven of this invention at positions around the machine chamber 40. That is, the microwave oven of this invention has the first cooling fan 24 used for cooling the upper heater 32*a*, the second cooling fan 26 used for cooling the heat generating elements within the machine chamber 40, such as the magnetron 44 and the high voltage transformer 46, and the third cooling fan 28 used for cooling the lower heater 32*b*. The above-mentioned three cooling fans 24, 26 and 28 together generate desired suction force for sucking atmospheric air into the external casing of the oven through the suction grille 10 while pressurizing the air, and, thereafter, guide the inflow air into the machine chamber 40 prior to allowing the air to pass through the cooking cavity 2, the upper inside air passage 18*a* and the lower heater cooling air passage 28*a*.

As shown in FIG. 1, the pressurized inflow air from the suction grille 10 partially flows through the first side air passage 22*a* formed inside the sidewall of the external casing of the oven by the suction force of the exhaust motor 22. The remaining inflow air flows into the machine chamber 40 through the air inlet opening 6. The air current, introduced into the machine chamber 40 through the opening 6, is formed by the suction force generated by the three cooling fans 24, 26 and 28 as described above.

In a brief description of the air currents within the external casing of the oven, the air flowing in the first side air passage 22*a* by the suction force of the exhaust motor 22 has a room temperature, which is a relatively low temperature. However, the air from lower air passage 18*c* has a high temperature since it absorbs heat from the upper and lower heaters 32*a* and 32*b* to cool the two heaters 32*a* and 32*b* while passing by the heaters. The lower temperature air is mixed with the high temperature air to become mixed air before the mixed air is finally discharged from the external casing to the atmosphere through the exhaust grille 20. Therefore, it is possible to reduce the temperature of exhaust air from the oven to a proper temperature almost completely free from thermally damaging or incapacitating a variety of elements installed on the front wall of the external casing of the oven or from making users standing or sitting in front of the oven feel unpleasant due to contact with hot exhaust air.

The operational effect of the microwave oven of this invention and air currents within the oven during a variety of operational modes performed using the upper and lower heaters and/or the magnetron will be described in detail as follows:

When the oven is turned on, a high voltage is applied from the high voltage transformer 46 to the magnetron 44, thus allowing the magnetron to be activated. The magnetron 44 thus generates high-frequency electromagnetic waves, and radiates the waves into the cavity 2. In such a case, the upper and lower heaters 32*a* and 32*b* may be turned on in accordance with a selected operational mode of the oven, and so the heaters 32*a* and 32*b* generate heat to radiate the heat into the cavity 2.

During an operational mode using the upper and lower heaters 32*a* and 32*b* in addition to the magnetron 44, the two heaters 32*a* and 32*b* and the magnetron 44 generate heat, and so it is necessary to form cooling air currents for cooling such heat generating elements. Therefore, the four suction force generating elements, that is, the exhaust motor 22, the upper and lower heater cooling fans 24 and 28, and the machine chamber cooling fan 26 are activated to form a desired suction force. It is thus possible to suck atmospheric air into the external casing of the oven through the suction grille 10 while pressurizing the air, and to form desired cooling air currents under pressure within said external casing as will be described herein below.

The inflow air having a room temperature from the suction grille 10 is partially guided into the machine chamber 40 through the air inlet opening 6 of the chamber 40, while the remaining inflow air is guided into the first side air passage 22*a* by the suction force of the exhaust motor 22.

The inflow air introduced into the machine chamber 40 flows as follows. That is, the upper heater cooling fan 24 forms a pressurized air current. This air current flows from the chamber 40 into the upper inside air passage 18*a*, and passes through the passage 18*a* while cooling the upper heater 32*a* installed on the top wall 2*b* of the cavity 2. The air current thus becomes a hot air current due to heat transferred from the heater 32*a* to the air. Thereafter, the hot air current flows down through the second side air passage 18*b* formed outside the sidewall 2*c* of the cavity 2. The lower end of the second side air passage 18*b* communicates with the inlet end of the lower air passage 18*c* externally formed along the bottom wall 2*a* of the cavity 2, and so the hot air current from the second side air passage 18*b* flows horizontally through the lower air passage 18*c* to be discharged from the outlet end of said passage 18*c*.

In addition to the above-mentioned air current formed by the upper heater cooling fan 24, the lower heater cooling fan 28 installed at a position under the bottom wall of the machine chamber 40 forms another air current. That is, the lower heater cooling fan 28 sucks the air from the machine chamber 40 to form a pressurized cooling air current flowing through the lower heater cooling air passage 28*a*. This cooling air current cools the lower heater 32*b* while passing through the passage 28*a*, and finally becomes a hot air current due to heat absorbed from the heater 32*b*.

At the lower air passage 18*c*, the hot air current from the lower heater cooling air passage 28*a* is mixed with the low temperature air current, which flows through the second side air passage 18*b* and the lower air passage 18*c* as described above. Therefore, a mixed air current having a reasonable low temperature is formed at the lower air passage 18*c*.

On the other hand, the inflow air, sucked into the external casing of the oven through the suction grille 10 due to the suction force of the exhaust motor 22 and having a room temperature, flows down through the first side air passage 22*a*, and is mixed with the hot air current flowing from the lower air passage 18*c*.

The hot air currents from the upper and lower heaters 32*a* and 32*b* are mixed with the low temperature air current at the lower air passage 18*c* to become a mixed air current having a reasonable low temperature. The low temperature mixed air current is, thereafter, discharged from the external casing to the atmosphere through the exhaust grille 20. Therefore, it is possible for the microwave oven of this invention to properly reduce the temperature of exhaust air within the external casing prior to discharging the air to the atmosphere through the exhaust grille 20.

The pressurized air current formed by the machine chamber cooling fan 26 flows within the machine chamber 40 while cooling the heat generating elements, such as the magnetron 44 and the high voltage transformer 46, to desired low temperatures. Thereafter, the air current under pressure is introduced from the chamber 40 into the cavity 2 through the air duct 48 as shown in FIG. 3, and is forcibly discharged from the cavity 2 together with steam and smoke generated from food during the heating and cooking process.

For example, the air current under pressure together with steam and smoke may be discharged from the cavity 2 to the outside of the upper partition panel 12 through the connection passage 12*d* extending from the interior of the cavity 2 to the outside of said partition panel 12. The discharged air current is, thereafter, sucked from the outside of the partition panel 12 to the sidewalls of the exhaust motor 22 prior to flowing down along the first side air passage 22*a*. The downward flowing air current through the passage 22*a* will be finally discharged from the external casing to the atmosphere through the exhaust grille 20 in the same manner as that described above.

Figure 6:
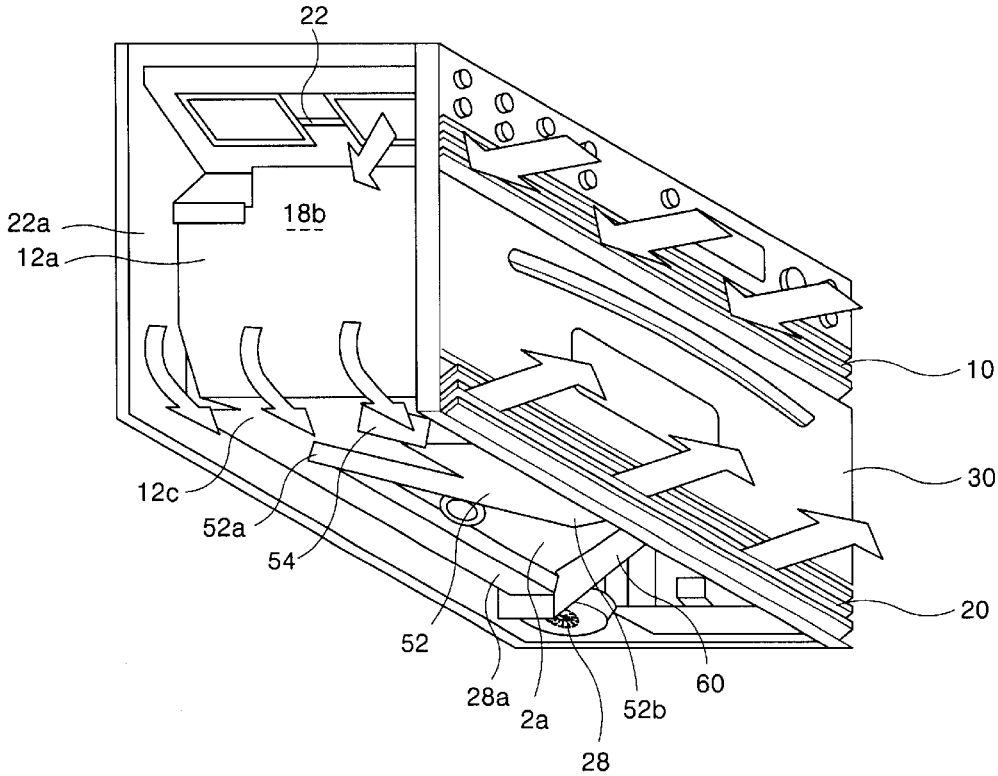
FIG. 6 is a bottom perspective view of a built-in microwave oven in accordance with the second embodiment of the present invention.

FIG. 6 is a bottom perspective view of a built-in microwave oven in accordance with -the second embodiment of the present invention. In the second embodiment of this invention, the general shape of the oven remains the same as that described for the primary embodiment, and so those elements common to both the primary and second embodiments will thus carry the same reference numerals.

This second embodiment is particularly designed to effectively, sufficiently and almost completely mix the hot air with the cool air into a mixed air having a reasonable low temperature prior to discharging the mixed air from the external casing through the exhaust grille 20. In the oven of this embodiment, the air flowing through the first side air passage 22*a* to reach a position just before the exhaust grille 20 has a low temperature, while the air from both the second side air passage 18*b* and the lower heater cooling air passage 28*a* has a high temperature. When such high temperature air is sufficiently mixed with the low temperature air as targeted by the second embodiment, it is possible to reduce the temperature of exhaust air of the oven to a reasonable low point free from thermally damaging or incapacitating the oven or making the users to feel unpleasant.

As shown in FIG. 6, the oven of this second embodiment has a central guide 52 positioned outside the bottom wall 2*a* of the cavity 2, with a sub-guide 54 installed at a position in front of the central guide 52.

The object of the above central guide 52 is to separately guide the outflow air from the first side air passage 22*a* to opposite sides of the exhaust grille 20 so as to discharge the exhaust air from the external casing through the opposite sides of said grille 20. In such a case, the central guide 52 is positioned such that its rear end 52*a* reaches the middle portion of the first side air passage 22*a*, with the front end 52*b* reaching the middle portion of the inside surface of the exhaust grille 20. Therefore, the air current, flowing down along the first side air passage 22*a*, is divided into two currents by the central guide 52 at a position under the lower partition panel 12*c*, thus forming a first air current passing along the left-hand side of the guide 52 and a second air current passing along the right-hand side of the guide 52. Of the two air currents, the first air current will be discharged from the external casing through the left-hand end portion of the exhaust grille 20, while the second air current will be discharged from the external casing through the right-hand end portion of said grille 20.

Such a central guide 52 is provided at a position above the lower partition panel 12*c* in addition to the position under said panel 12*c*. That is, one central guide 52 is provided under the bottom wall 2*a* of the cavity 2, with the other central guide 52 provided under the lower surface of the lower partition panel 12*c*. Therefore, it is possible to divide the hot air current flowing through the lower air passage 18*c* between the bottom wall 2*a* of the cavity 2 and the lower partition panel 12*c* into two air currents by the central guide 52 prior to being discharged from the external casing to the atmosphere through the opposite end portions of the exhaust grille 20.

The sub-guide 54 is installed on the lower surface of the lower air passage 12*c* at a position in front of the central guide 52. The installed direction of the sub-guide 54 is similar to that of the central guide 52, and is used for secondarily dividing the air current, flowing down from the first side air passage 22*a*, into a desired number of air currents. That is, the central guide 52 divides the exhaust air into two air currents discharged through the opposite end portions of the exhaust grille 20, while the sub-guide 54 divides the air current, guided to the left-hand end portion of the exhaust grille 20 by the central guide 52, into a desired number of air currents.

When air flows down along the first side air passage 22*a* and is discharged from the external casing to the atmosphere through the exhaust grille 20 in the microwave oven of the primary embodiment of this invention, there may be a difference between the amounts of air exhausted from the opposite end portions of the grille 20 such that the amount of exhaust air from the left-hand end portion of the grille 20 is less than that of the right-hand end portion, due to a centrifugal force. However, when such a central guide 52 is installed at a position just before the exhaust grille 20 as described above, it is possible to divide the exhaust air current into two or more air currents and to more effectively mix the hot air and cool air together. In addition, when such a sub-guide 54 is installed on the lower surface of the lower air passage 12*c* at a position in front of the central guide 52 as described above, it is possible to divide the air current, guided to the left-hand end portion of the exhaust grille 20 by the central guide 52, into a desired number of air currents by the sub-guide 54 prior to discharging the air through the exhaust grille 20.

As shown in FIG. 6, a partition wall 60 is installed on the bottom wall 2*a* of the cavity 2 at a desired position corresponding to the bottom of the machine chamber 40. That is, this partition wall 60 is positioned on the bottom wall 2*a* at a position around the junction of the chamber 40 and the cavity 2. In addition, the lower heater cooling air passage 28*a*, through which cooling air for the lower heater 32*b* passes, is formed at the left-hand side of the partition wall 60.

The object of the above partition wall 60 is to prevent hot air reaching the position under the cavity from being undesirably introduced into the machine chamber 40. The air flowing from the two side air passages 22*a* and 18*b* to reach the position under the cavity is hot air since it absorbs heat from the heat generating elements. In addition, the air flowing from the lower heater cooling air passage 28*a* is hot air since it absorbs heat from the lower heater 32*b*. Therefore, when such hot air is undesirably introduced into the machine chamber 40, the hot air may disturb the process of cooling the heat generating elements, such as the magnetron and the high voltage transformer, within the machine chamber 40. However, in the second embodiment of this invention, the partition wall 60 is installed on the bottom wall 2*a* of the cavity 2 at a desired position corresponding to the bottom of the machine chamber 40, thus almost completely preventing such hot air from being undesirably introduced into the machine chamber 40.

Figure 7:
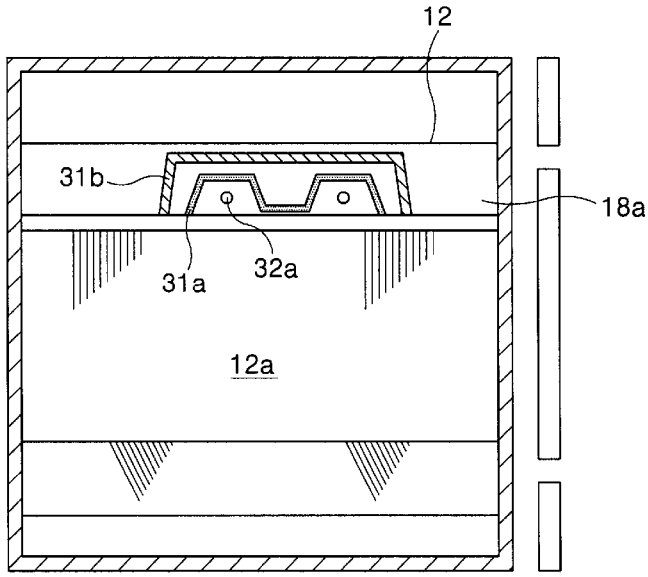
FIG. 7 is a sectional view of the built-in microwave oven of this invention taken along the line A—A of FIG. 4, with a structure for intercepting heat from an upper heater to prevent the heat from being transferred to the outside of the external casing of the oven in accordance with a modification of the primary embodiment.

FIG. 7 is a sectional view of the built-in microwave oven of this invention taken along the line A—A of FIG. 4, with a structure for intercepting heat from the upper heater 32*a* to prevent the heat from being transferred to the outside of the external casing of the oven in accordance with a modification of the primary embodiment. Since the microwave oven of this invention is designed as a built-in type oven installed in kitchen furniture and used as an integral part of the kitchen furniture, it is not preferable to allow heat to be transferred from the oven to the outside of the external casing of the oven. Therefore, it is necessary to provide a structure for intercepting heat from the upper and lower heaters 32*a* and 32*b* to prevent the heat from being transferred to the outside of the external casing of the oven. In this modification, the general shape of the oven remains the same as that described for the primary embodiment, and so those elements common to both the primary and second embodiments will thus carry the same reference numerals.

FIG. 7 clearly shows the heat intercepting structure provided around the upper heater 32*a*. As shown in the drawing, the heat intercepting structure has a reflection plate 31*a* at a position above the heater 32*a*. The above reflection plate 31*a* does not allow heat from the heater 32*a* to be transmitted to the outside of the external casing, but reflects the heat into the cavity 2. A channel member 31*b* is installed on the upper surface of the reflection plate 31*a* to form an air duct on the plate 31*a*. The above channel member 31*b* is positioned within the upper inside air passage 18*a*, and guides a part of the pressurized air current from the upper heater cooling fan 24 into the air duct formed by the channel member 31*b*.

Therefore, when the upper heater cooling fan 24 is activated, two pressurized air currents separately flow through the air duct inside the channel member 31*b* and through the upper inside air passage 18*a* at positions above the upper heater 32*a*, thus effectively intercepting heat from the heater 32*a*. Due to the heat intercepting structure with such double channels, it is possible to effectively and almost completely intercept heat from the upper heater 32*a* to prevent the heat from being transferred to the outside of the external casing of the oven. Therefore, this heat intercepting structure protects kitchen furniture integrated with the built-in microwave oven of this invention from heat of the oven, thereby preventing the furniture from being thermally damaged.

Figure 8:
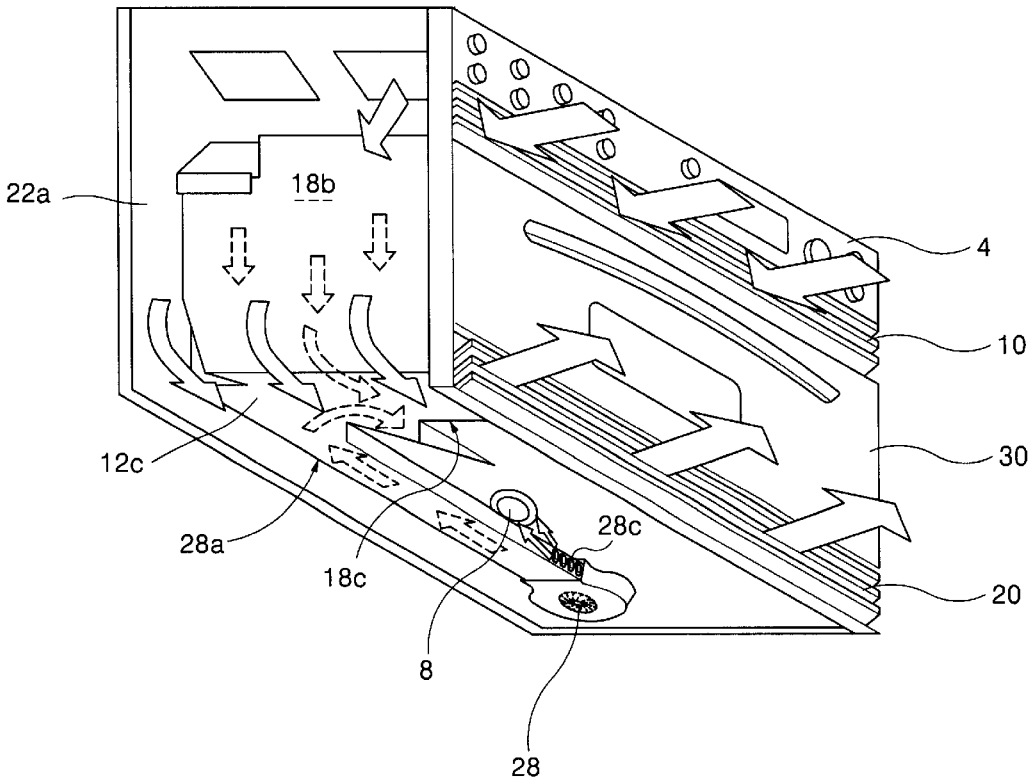
FIG. 8 is a bottom perspective view of a built-in microwave oven in accordance with the third embodiment of the present invention.

FIG. 8 is a bottom perspective view of a built-in microwave oven in accordance with the third embodiment of the present invention. The object of this third embodiment is to cool another heat generating element of the oven using the cooling air current flowing in the lower heater cooling air passage 28*a*.

As shown in FIG. 8, the cooling air current, formed by the lower heater cooling fan 28 and flowing in the lower heater cooling air passage 28*a*, is collaterally used for cooling a tray motor 8 installed at a position under the cavity 2.

The above tray motor 8 is used for generating a rotating force for rotating the food tray set within the cavity 2 in the same manner as that of conventional microwave ovens. In the present invention, the term "tray motor" has to be recognized as including a conventional power transmission gear mechanism used for transmitting the rotating force of the motor to the tray.

A plastic gear mechanism is set within the tray motor 8, and may be thermally damaged, deformed or incapacitated when it is used for a lengthy period of time. In the case of a microwave oven with a lower heater 32*b* in the same manner as described for the embodiments of this invention, the plastic gear mechanism may be excessively heated to a very high temperature by heat from the heater 32*b* during an operation of the oven.

In order to overcome such a problem, this third embodiment forms a separate air current for cooling such a tray motor 8. As shown in FIG. 8, a plurality of ventilation holes are formed along a sidewall of the lower heater cooling air passage 28*a* at a position around the tray motor 8, thus forming a louver 28*c*. The air current flowing in said passage 28*a* thus partially flows from the passage 28*a* to the tray motor 8 through the louver 28*c* to cool the motor 8.

That is, when a pressurized air current is formed by the lower heater cooling fan 28 and flows in the lower heat cooling air passage 28*a*, the air current partially flows from the passage 28*a* to the tray motor 8 through the louver 28*c*, thus effectively cooling the motor 8. In the present invention, it is preferred to form the louver 28*c* at a posit-ion around the air inlet end portion of the passage 28*a*. In such a case, it is possible to allow the air current within the passage 28*a* to flow to the tray motor 8 before it passes by the upper heater 32*a*. When the louver 28*c* is designed to guide the air current from the passage 28*a* to the tray motor 8 at a position after the upper heater 32*a*, it is impossible to guide low temperature air to the tray motor, and so a desired tray motor cooling effect cannot be accomplished.

The air discharged from the lower heater cooling air passage 28*a* through the louver 28*c* passes by the tray motor 8 to cool the motor 8 prior to being discharged from the external casing to the atmosphere through the exhaust grille 20.

In a brief description, the built-in microwave oven of this invention is characterized as follows.

1. In the built-in microwave oven of this invention, a suction grille 10 and an exhaust grille 20 are provided on the front wall of the external casing of the oven, and so inflow air from the suction grille 10 flows in the interior of the oven to cool the heat generating elements to proper temperatures prior to being discharged from the external casing to the atmosphere through the exhaust grille 20.

2. The hot air from the upper and lower heaters is mixed with lower temperature air flowing from the first side air passage 22*a* at a position just before the exhaust grille 20, and so the exhaust air from the exhaust grille 20 of the oven is not high, but is proper in its temperature.

Therefore, it is apparent that the object of both the exhaust motor 22 and the first side air passage 22*a* provided within the oven of this invention is to supply a cool air current having a room temperature to the hot air currents from the upper and lower heaters 32*a* and 32*b*, thus making the two types of air currents mix together to become a mixed air current having a reasonable low temperature prior to discharging the air from the external casing to the atmosphere through the exhaust grille 20.

In the preferred embodiments of this invention, the passage for guiding the low temperature inflow air from the suction grille 10 to the hot air from the heaters 32*a* and 32*b* is formed by the first side air passage 22*a*. However, it should be understood that the construction of the passage for the low temperature inflow air is not limited to the first side air passage 22*a*. That is, it is possible to accomplish the desired operational effect of the present invention by guiding the low temperature inflow air from the suction grille 10 to the hot air from the heaters 32*a* and 32*b* through a channel between the sidewall of the external casing and the sidewall of the cavity within the oven, a channel between the rear wall of the external casing and the rear wall of the cavity, in place of the first side air passage 22*a*, when the lower temperature air from the suction grille 10 is mixed with the hot air from the heaters 32*a* and 32*b* at a position before the exhaust grille 20.

INDUSTRIAL APPLICABILITY

As described above, the present invention provides a built-in microwave oven, designed to allow cooling air for heat generating elements to be sucked into and discharged from the external casing through the front wall of the oven. It is thus possible to provide effective built-in microwave ovens.

In the built-in microwave oven of this invention, hot air flowing from at least one heater is mixed with cool air having a room temperature sucked into the external casing of the oven through the suction grille, and so it is possible to effectively reduce the temperature of exhaust air discharged from the external casing through the exhaust grille to a proper temperature. Therefore, the exhaust air of the built-in microwave oven of this invention is almost completely free from thermally damaging or incapacitating the elements set on the front wall of the oven or undesirably making users standing or sitting in front of the oven feel unpleasant.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A built-in microwave oven, comprising:

a suction grille provided on an upper portion of a front wall of an external casing of said microwave oven for sucking air into the external casing;

an exhaust grille provided on a lower portion of said front wall of the external casing for discharging air from the external casing to the atmosphere; and means for forming air currents within the external casing while guiding inflow air from the suction grille to allow the inflow air to pass within the external casing prior to discharging the air from the external casing to the atmosphere through the exhaust grille; and means for cooling the air prior to discharging the air to the atmosphere.

2. A built-in microwave oven, comprising:

a suction grille provided on a front wall of an external casing of said microwave oven at a predetermined position for inflowing atmospheric air into the external casing;

an exhaust grille provided on said front wall of the external casing at another predetermined position for discharging air from the external casing to the atmosphere;

at least one heating means used for heating food seated within a cooking cavity of the oven;

a first air passage guiding a part of inflow atmospheric air from the suction grille to the exhaust grille;

a second air passage guiding a remaining part of the inflow atmospheric air from the suction grille to the exhaust grille while allowing the air to pass by said heating means to cool the heating means; and means for forming air currents within the external casing by sucking the inflow atmospheric air through the suction grille and by allowing the inflow atmospheric air to pass through both the first and second air passages prior to discharging the air from the external casing to the atmosphere through the exhaust grille, whereby said first air passage is configured to cool the air of the second air passage at a position before the exhaust grille.

3. The built-in microwave oven according to claim 2, wherein said suction grille is provided on the front wall of said external casing at a predetermined upper position, and said exhaust grille is provided on the front wall of said external casing at a predetermined lower position.

4. The built-in microwave oven according to claim 3, wherein said partition panel unit comprises:

an upper partition panel dividing a channel between a top wall of said cavity and a top wall of said external casing;

a side partition panel dividing a channel between a sidewall of said cavity and a sidewall of said external casing; and a lower partition panel dividing a channel between a bottom wall of said cavity and a bottom wall of said external casing;

wherein said upper, side and lower partition panels continuously extend from each other, thus each dividing the channel between the cooking cavity and the external casing into one inside passage and one outside passage, and said lower partition panel is provided at a predetermined portion on the bottom wall of said cooking cavity for allowing the inside and outside passages formed by said lower partition panel to be joined together.

5. The built-in microwave oven according to claim 3, wherein said heating means comprises an upper heater externally provided on a top wall of said cavity, and a lower heater externally provided on a bottom of said cavity, with a lower heater cooling air passage formed around the lower heater to allow an air current to flow through while cooling said lower heater, and fourth air current forming means for forming the air current flowing in said lower heater cooling air passage, whereby the air current from said lower heater cooling air passage is discharged from the external casing to the atmosphere through the exhaust grille.

6. The built-in microwave oven according to claim 2, further comprising a channel member used for forming an air duct and guiding an air current to flow through the air duct so as to prevent heat of said heating means from being transferred to said external casing.

7. The built-in microwave oven according to claim 6, further comprising a reflection plate installed within said channel member for reflecting heat from said heating means into said cavity.

8. The built-in microwave oven of claim 2, comprising at least one partition panel separating the first air passage and the second air passage, respectively.

9. A built-in microwave oven, comprising:

an external casing forming a profile of said microwave oven;

a cooking cavity set within the external casing and used for heating food seated therein;

a partition panel unit used for dividing a channel between said external casing and said cooking cavity into inside and outside passages;

heating means installed within said inside passage between the partition panel unit and a top wall of the cavity and used for generating heat and radiating the heat into said cooking cavity;

a suction grille and an exhaust grille provided on a front wall of said external casing at predetermined upper and lower positions, respectively;

first air current forming means for guiding inflow air from the suction grille to allow said air to pass through said inside passage between the partition panel unit and a top wall of the cavity while cooling the heating means prior to discharging the air from the external casing to the atmosphere through the exhaust grille; and second air current forming means for guiding the inflow air from the suction grille to allow said air to pass through said outside passage between the partition panel unit and a top wall of said external casing prior to reaching the exhaust grille;

whereby an air current formed by the first air current forming means is mixed with another air current formed by the second air current forming means prior to being discharged from the external casing to the atmosphere through the exhaust grille.

10. The built-in microwave oven according to claim 9, further comprising a machine chamber provided within said external casing at a position around the cooking cavity, and encasing high-frequency electromagnetic wave generating means therein; and third air current forming means for partially guiding the inflow air from the suction grille to allow said air to pass through the machine chamber prior to reaching the exhaust grille.

11. The built-in microwave oven according to claim 10, wherein said partition panel unit comprises:

an upper partition panel dividing a channel between a top wall of said cavity and a top wall of said external casing;

a side partition panel dividing a channel between a sidewall of said cavity and a sidewall of said external casing; and a lower partition panel dividing a channel between a bottom wall of said cavity and a bottom wall of said external casing;

wherein said upper, side and lower partition panels continuously extend from each other, thus each dividing the channel between the cooking cavity and the external casing into one inside passage and one outside passage, and said lower partition panel is provided at a predetermined portion on the bottom wall of said cooking cavity for allowing the inside and outside passages formed by said lower partition panel to be joined together.

12. The built-in microwave oven according to claim 10, wherein said partition panel unit comprises:

an upper partition panel dividing a channel between a top wall of said cavity and a top wall of said external casing;

a side partition panel dividing a channel between a sidewall of said cavity and a sidewall of said external casing; and a lower partition panel dividing a channel between a bottom wall of said cavity and a bottom wall of said external casing;

wherein said upper, side and lower partition panels continuously extend from each other, thus each dividing the channel between the cooking cavity and the external casing into one inside passage and one outside passage, and said lower partition panel is provided at a predetermined portion on the bottom wall of said cooking cavity for allowing the inside and outside passages formed by said lower partition panel to be joined together.

13. The built-in microwave oven according to claim 10, wherein said heating means comprises an upper heater externally provided on a top wall of said cavity, and a lower heater externally provided on a bottom of said cavity, with a lower heater cooling air passage formed around the lower heater to allow an air current to flow through while cooling said lower heater, and fourth air current forming means for forming the air current flowing in said lower heater cooling air passage, whereby the air current from said lower heater cooling air passage is discharged from the external casing to the atmosphere through the exhaust grille.

14. The built-in microwave oven according to claim 10, further comprising a partition wall installed at a junction of the bottom wall of said cavity and the bottom wall of said machine chamber and used for preventing exhaust air from being undesirably introduced into said machine chamber prior to being discharged from the external casing to the atmosphere through the exhaust grille.

15. The built-in microwave oven according to claim 9, wherein said partition panel unit comprises:

an upper partition panel dividing a channel between a top wall of said cavity and a top wall of said external casing;

a side partition panel dividing a channel between a sidewall of said cavity and a sidewall of said external casing; and a lower partition panel dividing a channel between a bottom wall of said cavity and a bottom wall of said external casing, whereby said upper, side and lower partition panels continuously extend from each other, thus each dividing the channel between the cooking cavity and the external casing into one inside passage and one outside passage, and said lower partition panel is provided at a predetermined portion on the bottom wall of said cooking cavity for allowing the inside and outside passages formed by said lower partition panel to be joined together.

16. The built-in microwave oven according to claim 15, further comprising a central guide provided within the external casing at a position before the exhaust grille for guiding a mixed air current, formed by a mixing of the air currents from the inside and outside passages defined under the bottom wall of said cavity by said lower partition panel, to opposite end portions of the exhaust grille.

17. The built-in microwave oven according to claim 16, further comprising a sub-guide provided at a position under the lower partition panel and used for secondarily dividing an air current, flowing from the outside passage defined outside the sidewall of said cavity and guided along a sidewall of said central guide toward an end portion of said exhaust grille, into two air currents.

18. The built-in microwave oven according to claim 9, wherein said heating means comprises an upper heater externally provided on a top wall of said cavity, and a lower heater externally provided on a bottom wall of said cavity, with a lower heater cooling air passage formed around the lower heater to allow an air current to flow through while cooling said lower heater, and fourth air current forming means for forming the air current flowing in said lower heater cooling air passage, whereby the air current from said lower heater cooling air passage is discharged from the external casing to the atmosphere through the exhaust grille.

19. The built-in microwave oven according to claim 18, wherein said lower heater cooling air passage communicates with an end of a lower air passage defined between a lower partition panel and a bottom wall of said cavity.

20. The built-in microwave oven according to claim 9, further comprising a central guide provided within the external casing at a position before the exhaust grille for separately guiding the air from the inside passage and the air from the outside passage to opposite end portions of the exhaust grille.

21. The built-in microwave oven according to claim 9, further comprising a channel member used for forming an air duct and guiding an air current to flow through the air duct so as to prevent heat of said heating means from being transferred to said external casing.

22. A built-in microwave oven, comprising:

an external casing forming a profile of said microwave oven;

a cooking cavity set within the external casing and used for heating food seated therein;

a machine chamber provided within said external casing at a position around the cooking cavity, and encasing high-frequency electromagnetic wave generating means therein;

heating means for generating heat and radiating the heat into said cooking cavity;

a suction grille and an exhaust grille provided on a front wall of said external casing at predetermined upper and lower positions, respectively;

air current forming means for guiding inflow air from the suction grille to allow said air to pass within the external casing prior to discharging the air from the external casing to the atmosphere through the exhaust grille;

a first passage used for partially and directly guiding the inflow air from said suction grille to said exhaust grille;

a second passage used for partially guiding the inflow air from the suction grille to allow said air to pass by the heating means while cooling the heating means prior to reaching the exhaust grille; and a third passage used for partially guiding the inflow air from the suction grille to allow said air to pass through the machine chamber prior to reaching the exhaust grille, whereby said first, second and third passages are joined together at a position before the exhaust grille.

23. The built-in microwave oven according to claim 22, further comprising a partition wall installed at a junction of the bottom wall of said cavity and the bottom wall of said machine chamber and used for preventing exhaust air from being undesirably introduced into said machine chamber prior to being discharged from the external casing to the atmosphere through the exhaust grille.

24. The built-in microwave oven according to claim 22, wherein said partition panel unit comprises:

an upper partition panel dividing a channel between a top wall of said cavity and a top wall of said external casing;

a side partition panel dividing a channel between a sidewall of said cavity and a sidewall of said external casing; and a lower partition panel dividing a channel between a bottom wall of said cavity and a bottom wall of said external casing;

wherein said upper, side and lower partition panels continuously extend from each other, thus each dividing the channel between the cooking cavity and the external casing into one inside passage and one outside passage, and said lower partition panel is provided at a predetermined portion on the bottom wall of said cooking cavity for allowing the inside and outside passages formed by said lower partition panel to be joined together.

25. The built-in microwave oven according to claim 22, wherein said heating means comprises an upper heater externally provided on a top wall of said cavity, and a lower heater externally provided on a bottom of said cavity, with a lower heater cooling air passage formed around the lower heater to allow an air current to flow through while cooling said lower heater, and fourth air current forming means for forming the air current flowing in said lower heater cooling air passage, whereby the air current from said lower heater cooling air passage is discharged from the external casing to the atmosphere through the exhaust grille.

26. The built-in microwave oven according to claim 22, further comprising a channel member used for forming an air duct and guiding an air current to flow through the air duct so as to prevent heat of said heating means from being transferred to said external casing.

27. A built-in microwave oven, comprising:

an external casing forming a profile of said microwave oven;

a cooking cavity set within the external casing and used for heating food seated therein;

a machine chamber provided within said external casing at a position around the cooking cavity, and encasing high-frequency electromagnetic wave generating means therein;

heating means for generating heat and radiating the heat into said cooking cavity;

a suction grille and an exhaust grille provided on a front wall of said external casing at predetermined upper and lower positions, respectively;

air current forming means for guiding inflow air from the suction grille to allow said air -to pass within the external casing prior to discharging the air from the external casing to the atmosphere through the exhaust grille;

a first passage used for partially guiding the inflow air from the suction grille to allow said air to pass by the heating means prior to reaching the exhaust grille; and a second passage used for partially guiding the inflow air from the suction grille to allow said air to pass through the machine chamber prior to reaching the exhaust grille, whereby said first and second passages are joined together at a position before the exhaust grille.

28. The built-in microwave oven according to claim 27, wherein said partition panel unit comprises:

an upper partition panel dividing a channel between atop wall of said cavity and a top wall of said external casing;

a side partition panel dividing a channel between a sidewall of said cavity and a sidewall of said external casing; and a lower partition panel dividing a channel between a bottom wall of said cavity and a bottom wall of said external casing;

wherein said upper, side and lower partition panels continuously extend from each other, thus each dividing the channel between the cooking cavity and the external casing into one inside passage and one outside passage, and said lower partition panel is provided at a predetermined portion on the bottom wall of said cooking cavity for allowing the inside and outside passages formed by said lower partition panel to be joined together.

29. The built-in microwave oven according to claim 27, wherein said heating means comprises an upper heater externally provided on a top wall of said cavity, and a lower heater externally provided on a bottom of said cavity, with a lower heater cooling air passage formed around the lower heater to allow an air current to flow through while cooling said lower heater, and fourth air current forming means for forming the air current flowing in said lower heater cooling air passage, whereby the air current from said lower heater cooling air passage is discharged from the external casing to the atmosphere through the exhaust grille.

30. The built-in microwave oven according to claim 27, further comprising a partition wall installed at a junction of the bottom wall of said cavity and the bottom wall of said machine chamber and used for preventing exhaust air from being undesirably introduced into said machine chamber prior to being discharged from the external casing to the atmosphere through the exhaust grille.

31. The built-in microwave oven according to claim 27, further comprising a channel member used for forming an air duct and guiding an air current to flow through the air duct so as to prevent heat of said heating means from being transferred to said external casing.

* * * * *